US007773054B2

(12) United States Patent
Jeong

(10) Patent No.: US 7,773,054 B2
(45) Date of Patent: Aug. 10, 2010

(54) ORGANIC LIGHT EMITTING DIODE DISPLAY

(75) Inventor: Jin Tae Jeong, Seoul (KR)

(73) Assignee: Samsung Mobile Display Co., Ltd., Yongin-si (KR)

( * ) Notice: Subject to any disclaimer, the term of this patent is extended or adjusted under 35 U.S.C. 154(b) by 1206 days.

(21) Appl. No.: 11/218,911

(22) Filed: Sep. 1, 2005

(65) Prior Publication Data

US 2006/0066532 A1 Mar. 30, 2006

(30) Foreign Application Priority Data

Sep. 8, 2004 (KR) ..... 10-2004-0071560

(51) Int. Cl.
*G09G 3/30* (2006.01)

(52) U.S. Cl. ..... 345/76; 345/82; 315/169.3

(58) Field of Classification Search ..... 345/76–83; 315/169.1, 169.3; 313/463
See application file for complete search history.

(56) References Cited

U.S. PATENT DOCUMENTS

2002/0118150 A1 8/2002 Kwon
2003/0103022 A1 * 6/2003 Noguchi et al. ..... 345/77
2003/0201960 A1 * 10/2003 Fujieda ..... 345/87
2004/0145547 A1 * 7/2004 Oh ..... 345/76
2005/0052365 A1 3/2005 Jang

FOREIGN PATENT DOCUMENTS

EP 1220191 A2 * 7/2002

* cited by examiner

*Primary Examiner*—Alexander S. Beck
*Assistant Examiner*—Seokyun Moon
(74) *Attorney, Agent, or Firm*—Christie, Parker & Hale, LLP

(57) ABSTRACT

An organic light emitting diode display includes a pixel having: a first capacitor connected between a first node and a second node; a second capacitor connected between the first node and a third node; a first switching device connected between a data line and the first node, and for selectively delivering a data signal to the first node; a second switching device connected to the second node, and for selectively delivering a first power to the second node; a third switching device connected to the first node and the third node, and for selectively delivering a voltage at the third node to the first node; a driving device connected to the second node, and for causing a driving current to flow in response to a voltage at the second node; and a light emitting diode connected to the driving device, and for emitting a light in response to the driving current flowing into the light emitting diode.

24 Claims, 10 Drawing Sheets

ORGANIC LIGHT EMITTING DIODE DISPLAY

CROSS-REFERENCE TO RELATED APPLICATION

This application claims priority to and the benefit of Korean Patent Application No. 10-2004-0071560, filed on Sep. 8, 2004, in the Korean Intellectual Property Office, the entire content of which is incorporated herein by reference.

BACKGROUND

1. Field of the Invention

The present invention relates to an organic light emitting diode display and, more specifically, to an organic light emitting diode display capable of improving uniformity in brightness by compensating a threshold voltage of a driving transistor.

2. Discussion of Related Art

Recently, various flat panel displays having weight and volume less than a comparable cathode ray tube display have been developed. Among these, organic light emitting diode (OLED) displays have drawn a lot of attention because of its excellent emission efficiency, brightness and viewing angle, as well as its quick response time.

The light emitting diode has a structure including an emission layer (or a thin film for emitting light) interposed between a cathode electrode and an anode electrode, and has a characteristic in which electrons and holes are injected into the emission layer and then recombined to generate an exciton that emits light when the exciton drops into a lower energy level.

In the light emitting diode, the emission layer is made of an inorganic or organic material, and can be classified as either an inorganic light emitting diode or an organic light emitting diode depending on the type of the emission layer.

FIG. 1 is a circuit diagram showing a pixel of a conventional organic light emitting diode display. Referring to FIG. 1, the pixel includes an organic light emitting diode (hereinafter, referred to as OLED), a driving transistor M2, a capacitor Cst, and a switching transistor M1. Further, a scan line Sn, a data line Dm, and a power line Vdd are connected to the pixel. The scan line Sn is formed in a row direction, and the data line Dm and the power line Vdd are formed in a column direction. Here, n is any integer between 1 and N, and m is any integer between 1 and M.

The switching transistor M1 has a source electrode connected to the data line Dm, a drain electrode connected to a first node A, and a gate electrode connected to the scan line Sn.

The driving transistor M2 has a source electrode connected to the pixel power line Vdd, a drain electrode connected to the OLED, and a gate electrode connected to the first node A. Further, the driving transistor M2 supplies a current to enable the OLED to emit light using a signal input to the gate electrode of the driving transistor M2. An amount of the current of the driving transistor M2 is controlled by a data signal applied through the switching transistor M1.

The capacitor Cst has a first electrode connected to the source electrode of the driving transistor M2, and a second electrode connected to the first node A, and retains a voltage between the source electrode of the driving transistor M2 and the gate electrode of the driving transistor M2 applied with the data signal, during a constant period.

With such a configuration, when the scan signal applied to the gate electrode of the switching transistor M1 turns on the switching transistor M1, a voltage corresponding to the data signal is charged into the capacitor Cst, and the voltage charged into the capacitor Cst is then applied to the gate electrode of the driving transistor M2, such that the driving transistor M2 allows the current to flow. Thus, the OLED emits light.

Here, the current flowing through the OLED provided by the driving transistor M2 is represented by the following equation 1:

$$I_{OLED} = \frac{\beta}{2}(Vgs - |Vth|)^2 = \frac{\beta}{2}(Vdd - Vdata - Vth)^2 \quad \text{[Equation 1]}$$

where, $I_{OLED}$ is a current flowing through the OLED, Vgs is a voltage between the source and the gate of the driving transistor M2, Vth is a threshold voltage of the driving transistor M2, Vdata is a data signal voltage, and β is a gain factor of the driving transistor M2.

From the equation 1, it can be seen that the current $I_{OLED}$ flowing through the OLED varies with the threshold voltage of the driving transistor M2.

However, an organic light emitting diode display has a problem in that deviation of threshold voltages of driving transistors can arise in a manufacturing process, and thus, brightness varies due to a non-uniform amount of currents flowing through OLEDs caused by the deviation of the threshold voltages of the driving transistors (e.g., the driving transistor M2).

SUMMARY OF THE INVENTION

Accordingly, an embodiment of the present invention provides an organic light emitting diode display in which a current flowing through a driving transistor is allowed to flow irrespective of a threshold voltage of the driving transistor, such that a difference between threshold voltages of various driving transistors is compensated, thereby preventing a non-uniform brightness of the organic light emitting diode display.

One embodiment of the present invention is to provide a pixel including: a first capacitor connected between a first node and a second node; a second capacitor connected between the first node and a third node; a first switching device connected between a data line and the first node, and for selectively delivering a data signal to the first node; a second switching device connected to the second node, and for selectively delivering a second power of a second power source to the second node; a third switching device connected to the first node and the third node, and for selectively delivering a voltage at the third node to the first node; a driving device connected to the second node, and for causing a driving current to flow in response to a voltage at the second node; and a light emitting diode connected to the driving device, and for emitting a light in response to the driving current flowing into the light emitting diode.

One embodiment of the present invention is to provide a pixel including: a light emitting diode; a driving transistor for causing a driving current to flow through the light emitting diode; a first switching unit for selectively delivering a data signal; a second switching unit for selectively delivering a first power of a first power source; and a storage unit for supplying a voltage to a gate electrode of the driving transistor, wherein, when the first power of the first power source is not delivered to the storage unit, the storage unit applies a second voltage of a second power source to the gate electrode of the driving transistor to store a first voltage, wherein the storage unit then stores a second voltage corresponding to the data signal and applies the first voltage and the second voltage to the gate electrode of the driving transistor, and wherein the first voltage comprises a voltage difference between a source electrode of the driving transistor and the gate electrode of the driving transistor.

One embodiment of the present invention is to provide a pixel including: a light emitting diode; a driving transistor for causing a current to flow through the light emitting diode; a second switching transistor for selectively delivering a first power to a gate electrode of the driving transistor in response to a first scan signal; a third switching transistor for selectively delivering a voltage at a source electrode of the driving transistor in response to the first scan signal when the first power is applied to the gate electrode of the driving transistor; a fourth switching transistor for selectively delivering a second power to the driving transistor in response to a second scan signal; a first switching transistor for selectively delivering a data signal in response to a third scan signal; a first capacitor for storing a voltage having a voltage difference between the delivered data signal and the second power; and a second capacitor for storing a voltage having a threshold voltage of the driving transistor, wherein the driving transistor causes the current to flow through the light emitting diode in response to the voltages stored into the first capacitor and the second capacitor.

One embodiment of the present invention is to provide an organic light emitting diode display including: a plurality of scan lines including a first scan line, a second scan line, and a third scan line; a plurality of data lines for delivering data signals; and a plurality of pixels respectively connected to the scan lines and the data lines, wherein at least one of the pixels is a pixel according to any one of the above described embodiments.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

Figure 1:
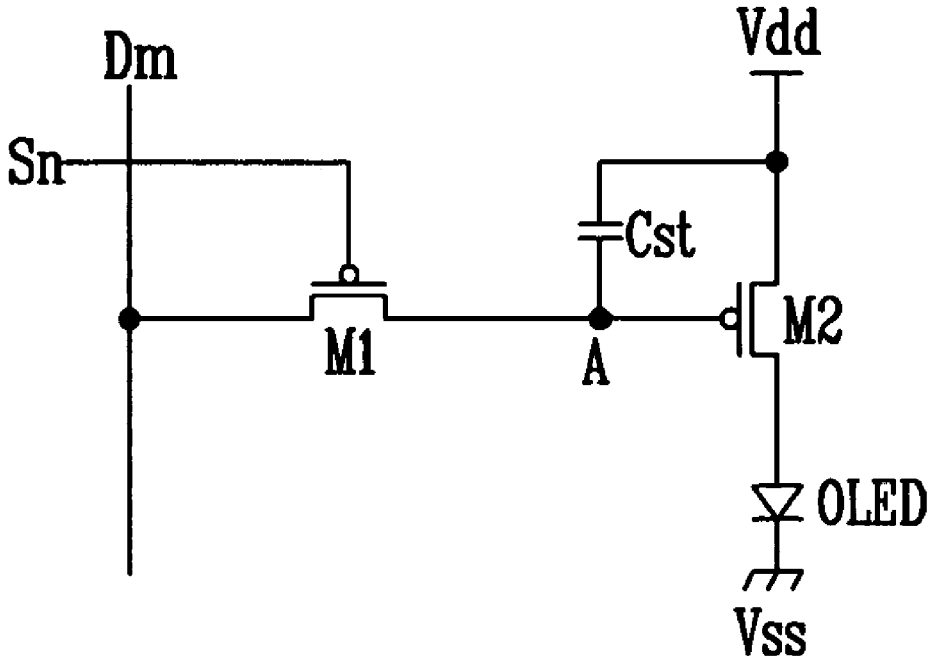
FIG. 1 (PRIOR ART)
FIG. 1 is a circuit diagram showing a pixel of a conventional organic light emitting diode display.

Hereinafter, certain exemplary embodiments according to the present invention will be described with reference to the accompanying drawings. Here, when one part is connected to another part, the one part may be directly connected to the another part or indirectly connected to the another part via a third part. Further, there may be parts shown in the drawings, or parts not shown in the drawings, that are not discussed in the specification, as they are not essential to a complete understanding of the invention. Also, like reference numerals refer to like elements throughout.

Figure 2:
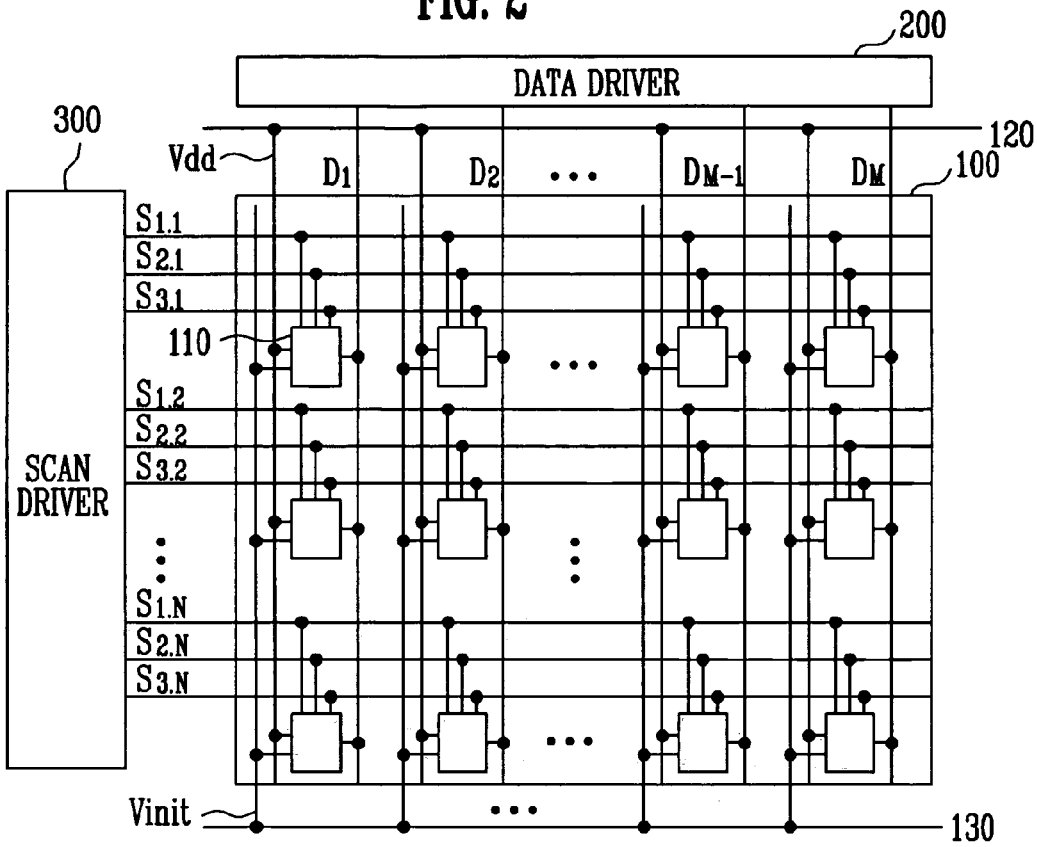
FIG. 2 is a schematic diagram of an organic light emitting diode display according to an embodiment the present invention.

FIG. 2 is a schematic diagram of an organic light emitting diode display according to an embodiment of the present invention. Referring to FIG. 2, the organic light emitting diode display according to the present invention includes a pixel portion 100, a data driver 200, and a scan driver 300.

The pixel portion 100 includes a plurality of pixels 110 including N×M OLEDs; N first scan lines S1.1, S1.2, . . . , S1.N−1, and S1.N, N second scan lines S2.1, S2.2., . . . , S2.N−1, and S2.N, and N third scan lines S3.1, S3.2, . . . , S3.N−1, and S3.N that are all arranged in a row direction; M data lines D1, D2, . . . , DM-1, DM arranged in a column direction, M pixel power lines Vdd for supplying a first power (e.g., a pixel voltage) of a first power source; and M compensation power lines Vinit for supplying a second power (e.g., a compensation voltage) of a second power source. In addition, to receive external power, each of the pixel power lines Vdd, is connected to a first power line 120, and each of the compensation power lines Vinit is connected to a second power line 130.

Further, the compensation power is delivered to the pixels 110 by a first scan signal (or first scan signals) delivered by the first scan lines S1.1, S1.2, . . . , S1.N−1, S1.N, and the pixel power is delivered to the pixels 100 by a second scan signal (or second scan signals) delivered to the second scan lines S2.1, S2.2, . . . , S2.N−1, S2.N. Further, a data signal (or data signals), delivered to the data lines D1, D2, . . . , DM-1, DM by a third scan signal (or third scan signals) delivered to the third scan lines S3.1, S3.2, . . . , S3.N−1, S3.N, is delivered to the pixels 110 to generate a drive current corresponding to the data signal.

The data driver 200 is connected to the data lines D1, D2, . . . , DM−1, DM to transmit the data signal or signals to the pixel portion 100.

The scan driver 300 is arranged at a side of the pixel portion 100, and is connected to the first scan lines S1.1, S1.2, . . . , S1.N−1, S1.N, the second scan lines S2.1, S2.2, . . . , S2.N−1, S2.N, and the third scan lines S3.1, S3.2, . . . , S3.N−1, S3.N for applying the first scan signal or signals, the second scan signal or signals and the third scan signal or signals to the pixel portion 100 to sequentially select rows of the pixel portion 100. The data driver 200 applies the data signal or signals into a selected row, and the pixels 110 of the selected row emit light in response to the data signal or signals.

Figure 3:
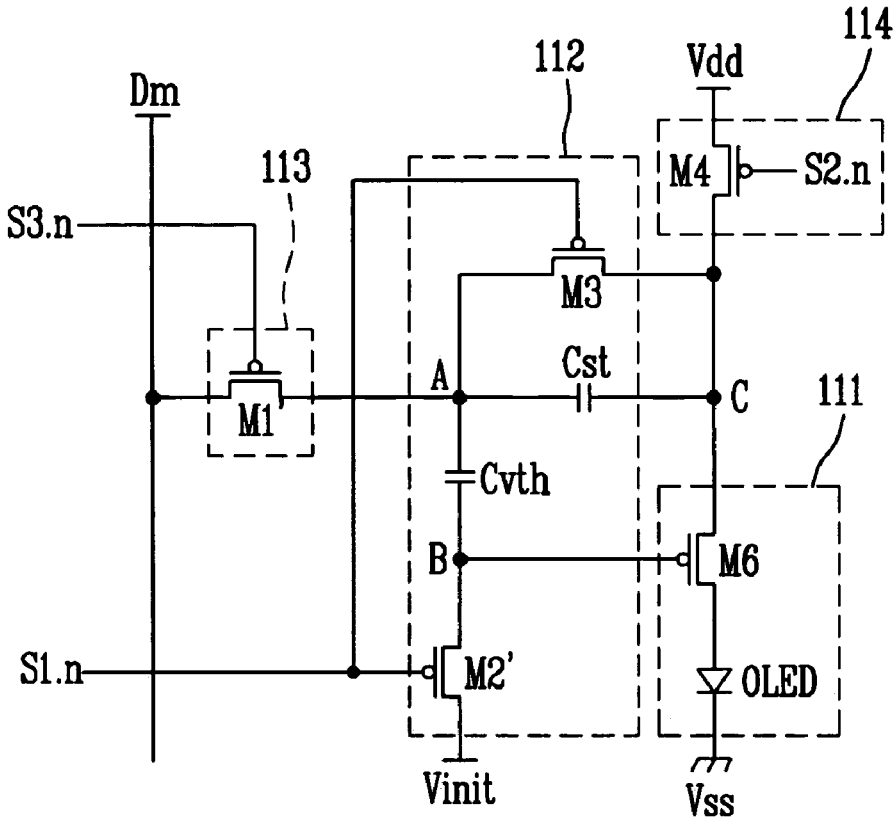
FIG. 3 is a circuit diagram showing a pixel according to an embodiment of the present invention.

FIG. 3 is a circuit diagram of a pixel according to an embodiment of the present invention. Referring to FIG. 3, the pixel includes a drive unit 111, a storage unit 112, a first switching unit 113, and a second switching unit 114.

The drive unit 111 causes the drive current to flow, and the voltage applied from the storage unit 112 determines an amount of the current flowing through the drive unit 111.

The storage unit 112 receives a compensation power, or a black data signal, through a compensation power line Vinit to send it to the drive unit 111, stores a voltage to compensate a threshold voltage of the drive unit 111, and stores a voltage corresponding to a data signal. The voltage to compensate the threshold voltage of the drive unit 111 and the voltage corresponding to the data signal are then delivered by the storage unit 112.

The first switching unit 113 receives the data signal and selectively transfers the data signal to the storage unit 112.

The second switching unit 114 selectively transmits a pixel power to a pixel through a pixel power line Vdd and causes a first power at a voltage of the pixel power line Vdd to not be applied to a driving transistor M6 during a process of storing the voltage into the storage unit 112, and applies the first power at the voltage of the pixel power line Vdd to the driving device when the storing into the storage unit 112 is completed.

Referring back to respective blocks, the drive unit 111 includes a thin film transistor M6 and an OLED, and the storage unit 112 includes a second switching transistor M2', a third switching transistor M3, a compensation capacitor Cvth, and a storage capacitor Cst. Further, the first switching unit 113 includes a first switching transistor M1', and the second switching unit 114 includes a fourth switching transistor M4.

Each of the first to fourth switching transistors M1', M2', M3, and M4 and the driving transistor M6 includes a gate electrode, a source electrode and a drain electrode, and the capacitor Cst has a first electrode and a second electrode.

The first switching transistor M1' has its gate electrode connected to the third scan line S3.*n*, its source electrode connected to the data line Dm, and its drain electrode connected to a first node A. Therefore, the data signal is delivered to the first node A in response to the third scan signal input through the third scan line S3.*n*.

The second switching transistor M2' has its gate electrode connected to the first scan line S1.*n*, its source electrode connected to the compensation power line Vinit, and its drain electrode connected to a second node B. Therefore, the compensation power input through the compensation power line Vinit is delivered to the second node B according to the first scan signal which is input through the first scan line S1.*n*. Further, the compensation power input through the compensation power line Vinit is maintained at a high level.

The storage capacitor Cst is connected to the first node A and a third node C, and a voltage difference between the voltage applied to the first node A and the voltage applied to the third node C is charged into the storage capacitor Cst and then applied to the gate electrode of the driving transistor M6 during one frame.

The third switching transistor M3 has its gate electrode connected to the first scan line S1.*n*, its source electrode connected to the first node A, and its drain electrode connected to the third node C. Therefore, the third node C and the first node A are connected according to the first scan signal which is input through the first scan line S1.*n*, and the voltage at the first node A becomes the voltage at the third node C.

A compensation capacitor Cvth has a first electrode having a potential value of the second node B, and a second electrode having a potential value of the third node C by mechanisms of the third switching transistor M3. Therefore, the compensation capacitor Cvth charges a voltage difference between a voltage at the second node B and a voltage at the third node C.

The driving transistor M6 has its gate electrode connected to the second node B, its source electrode connected to the third node C, and a drain electrode connected to an anode electrode of the OLED. In addition, the driving transistor M6 causes the current corresponding to the voltage applied to the gate electrode of the driving transistor M6 to flow through the drain electrode, thus supplying the current to the OLED.

The fourth switching device M4 has its gate electrode connected to the second scan line S2.*n*, its source electrode connected to the pixel power line Vdd that supplies the pixel power, and its drain electrode connected to the third node C. Therefore, the fourth switching device M4 performs a switching function according to the second scan signal S2.*n* which is input through the second scan line S2.*n* so that the pixel power is selectively applied to thereby control the current flowing through the OLED.

Here, n is any integer between 1 and N, and m is any integer between 1 and M.

Figure 4:
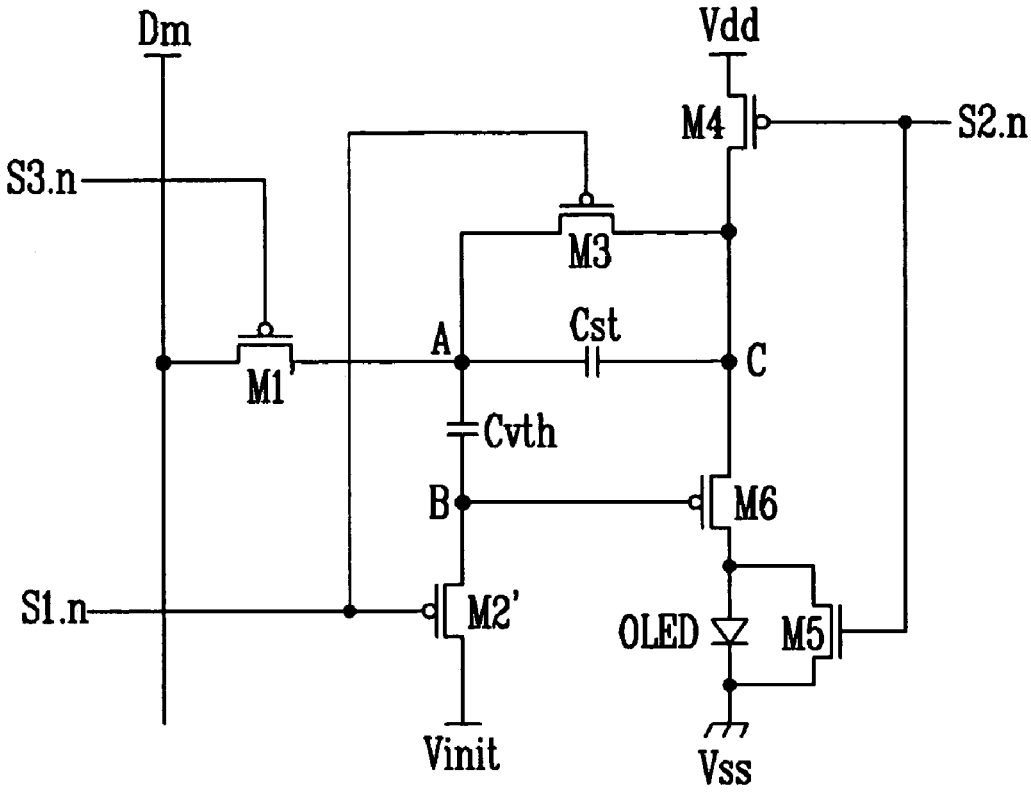
FIG. 4 is a circuit diagram showing a pixel according to another embodiment of the present invention.

FIG. 4 is a circuit diagram showing a pixel according to another embodiment of the present invention. Referring to FIG. 4, a difference with the embodiment of FIG. 3 is that a fifth switching transistor M5 is connected to the OLED in parallel.

The fifth switching transistor M5 has a gate electrode connected to the second scan line S2.*n*, a source electrode connected to a cathode electrode of the OLED, and a drain electrode connected to the anode electrode of the light emitting diode. Further, as shown in FIG. 4, the fifth switching transistor M5 uses an opposite polarity as compared with the fourth switching device M4 because the fourth switching device M4 is implemented with a P-type transistor and the fifth switching transistor M5 is implemented with an N-type transistor. Thus, the fifth switching transistor M5 remains in an off state when the fourth switching transistor M4 is turned on, and remains in an on state when the fourth switching transistor M4 is turned off.

Therefore, when the OLED emits light, the fifth switching transistor M5 is turned off so that the current flows only into the OLED, while when the OLED should not emit light, the fifth switching transistor M5 is turned on so that a leakage current and the like do not flow into the OLED, but rather flow into the fifth switching transistor M5, and thus, the OLED does not emit light.

Figure 5:
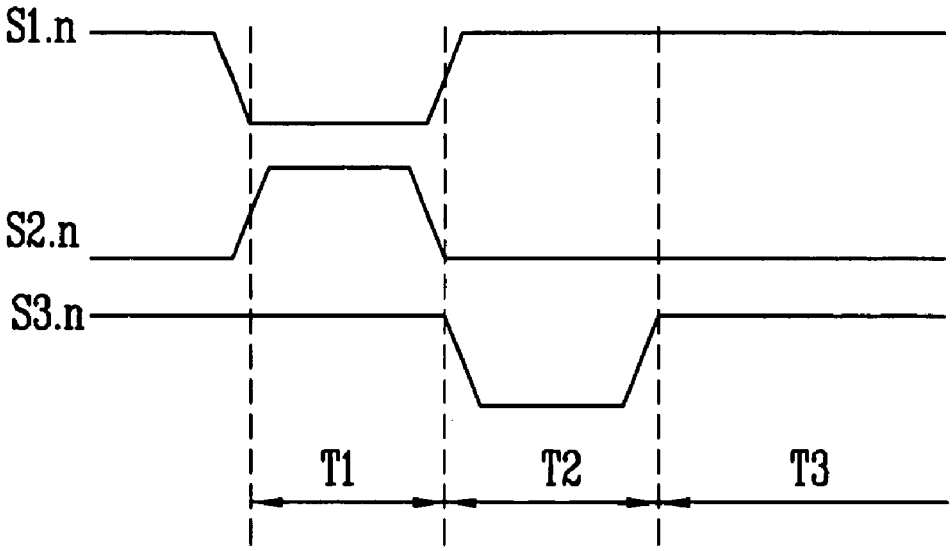
FIG. 5 is a timing diagram showing operation of the pixel shown in FIGS. 3 and 4.
Figure 6:
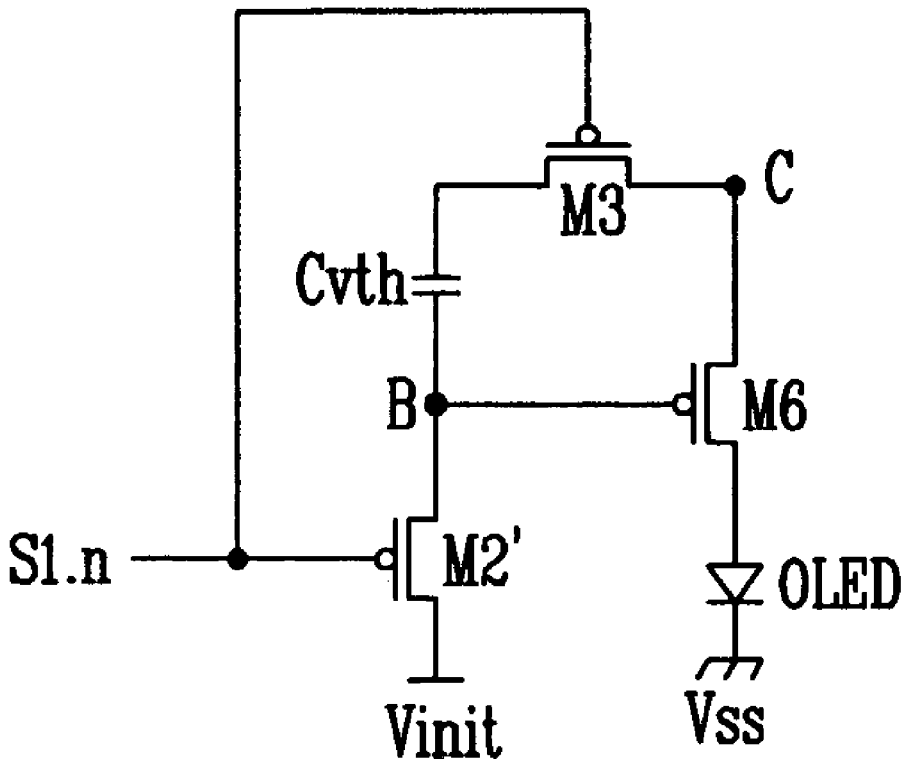
FIG. 6 is a circuit diagram for a process of compensating a threshold voltage of the pixel shown in FIGS. 3 and 4.
Figure 7:
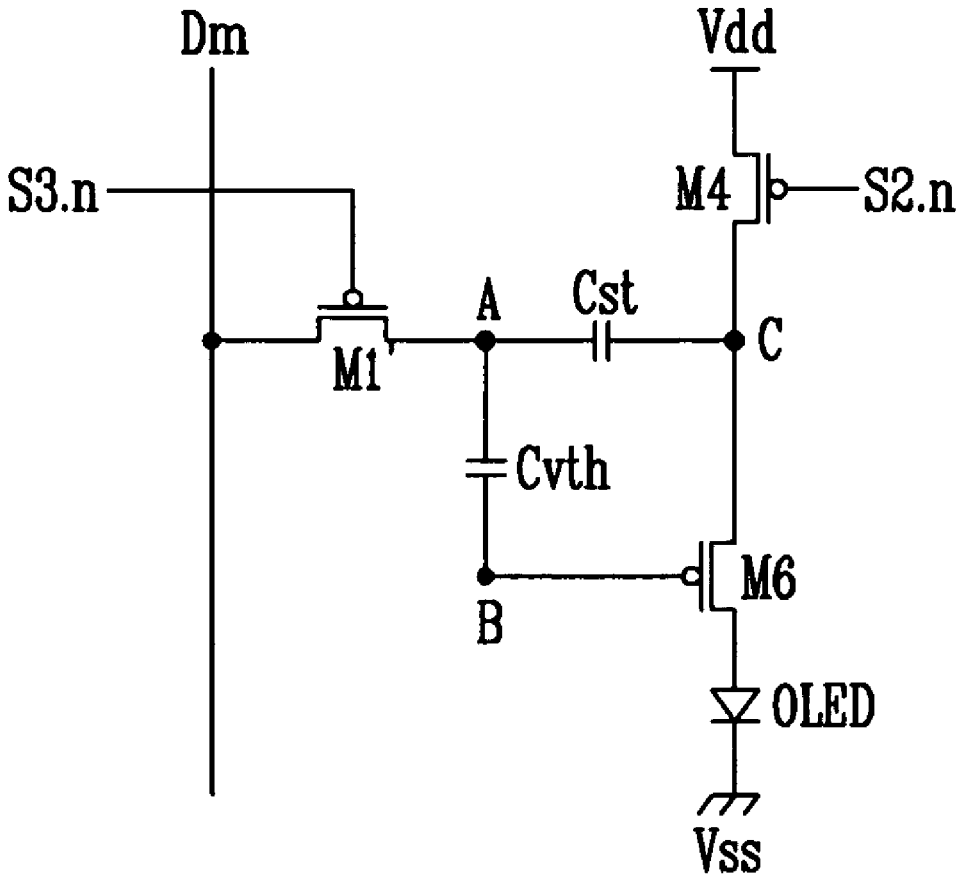
FIG. 7 is a circuit diagram for a process of recording a data signal.
Figure 8:
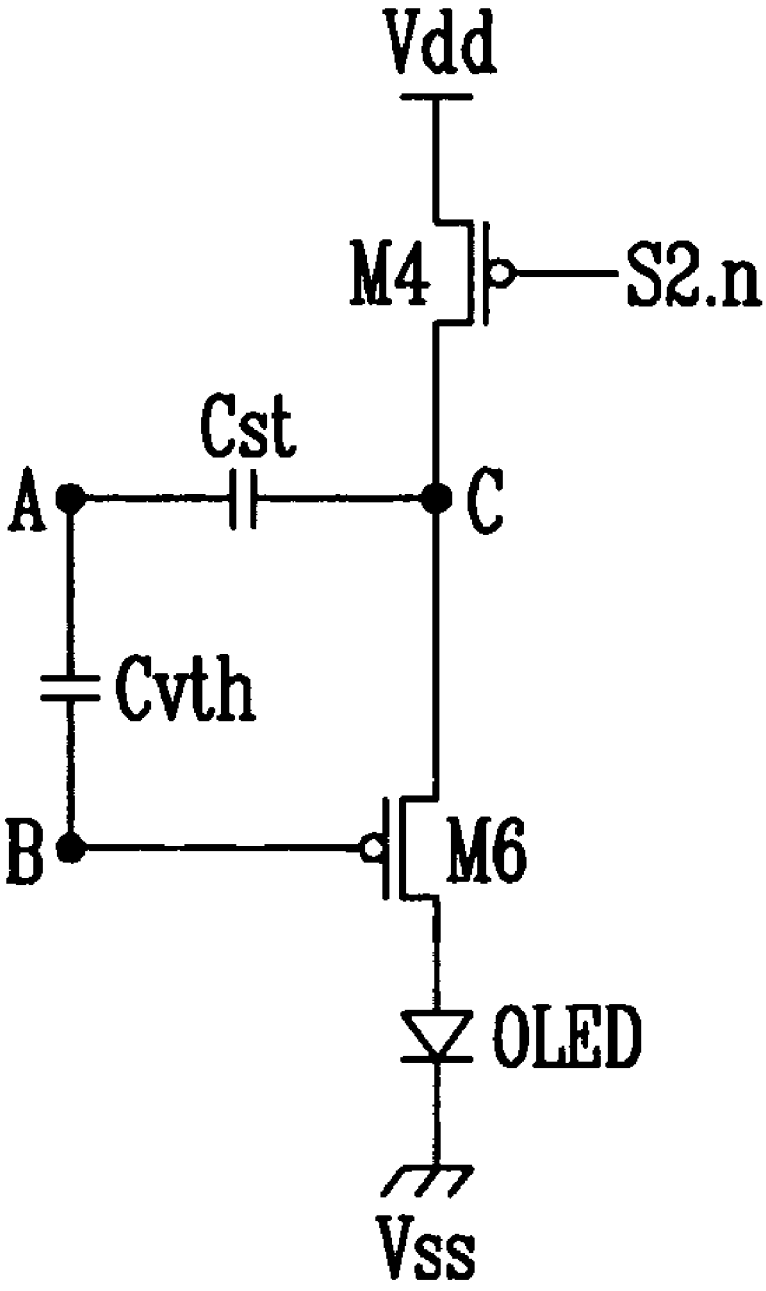
FIG. 8 is a circuit diagram for a process of causing a driving current of the pixel shown in FIGS. 3 and 4 to flow.

FIG. 5 is a timing diagram showing operation of the pixel shown in FIGS. 3 and 4; FIG. 6 is a circuit diagram for a process of compensating a threshold voltage of the pixel shown in FIGS. 3 and 4; FIG. 7 is a circuit diagram for a process of recording a data signal; and FIG. 8 is a circuit diagram for a process of causing a driving current of the pixel shown in FIGS. 3 and 4 to flow.

Referring to FIG. 5, in the first period T1, the first scan signal S1.*n* is converted from HIGH (e.g., a high voltage level) to LOW (e.g., a low voltage level), the second scan signal S2.*n* is converted from LOW to HIGH, and the third scan signal S3.*n* remains HIGH. In the second period T2, the first scan signal S1.*n* is converted from LOW to HIGH, the second scan signal S2.*n* is converted from HIGH to LOW, and the third scan signal S3.*n* is converted from HIGH to LOW. In the third period T3, the first scan signal S1.*n* remains HIGH, the second scan signal S2.*n* remains LOW, and the third scan signal S3.*n* is converted into HIGH and remains HIGH. Here, the first scan signal, the second scan signal, and the third scan signal S1.*n*, S2.*n*, and S3.*n* are periodic signals.

In the first period T1, the circuit is arranged as shown in FIG. 6. Circuit operation in the first period T1 is described with reference to FIG. 6. When the second switching transistor M2' and the third switching transistor M3 are turned on by the first scan signal S1.*n*, and the compensation power is applied to the second node B through the compensation power line Vinit, a voltage difference between the voltage of the compensation power and the threshold voltage of the driving transistor M6 is delivered to the third node C. Therefore, the threshold voltage of the driving transistor M6 is charged into the compensation capacitor Cvth.

Further, in the second period T2, the circuit is arranged as shown in FIG. 7. Circuit operation in the second period T2 is described with reference to FIG. 7. First, when the fourth switching transistor M4 is turned on by the second scan signal S2.*n* and the pixel power is delivered to the third node C, the pixel power starts to be charged into the storage capacitor Cst. In addition, at substantially the same time, the first switching transistor M1 is turned on by the third scan signal S3.*n*, and the data signal is delivered to the first node A. Therefore, a voltage having a voltage difference between the voltage at the data signal and the voltage at the pixel power delivered to the third node C is stored into the storage capacitor Cst.

Further, in the third period T3, the circuit is arranged as shown in FIG. 8. Circuit operation in the third period T3 is described with reference to FIG. 8. The second switching transistor M2' and the third switching transistor M3 are turned off by the first scan signal S1.*n*, and the fourth switching transistor M4 is turned on by the second scan signal S2.*n*, and the first switching transistor M1' is turned off by the third scan signal S3.*n*. Therefore, the voltage stored into the storage capacitor Cst and the voltage stored into the compensation capacitor Cvth are applied to the gate electrode of the driving transistor M6, and the pixel power is applied to the third node C. The applied voltage between the gate electrode and the source electrode of the driving transistor M6 is shown in the following equation 2:

$$Vgs = V\text{data} - Vdd + |Vth| \qquad \text{Equation [2]}$$

where, Vgs is a voltage between the gate electrode and the source electrode of the driving transistor M6, Vdata is a data signal voltage, Vdd is a pixel power voltage, and Vth is a threshold voltage of the driving transistor M6.

Therefore, the current flowing between the source electrode and the drain electrode of the driving transistor M6 is obtained as shown in the following equation 3.

$$I_{OLED} = \frac{\beta}{2}(Vgs - |Vth|)^2 = \frac{\beta}{2}(Vdata - Vdd)^2 \qquad \text{[Equation 3]}$$

where, $I_{OLED}$ is a current flowing through the OLED, Vgs is a voltage between the source and the gate of the driving transistor M6, Vth is a threshold voltage of the driving transistor M6, Vdata is a data signal voltage, and β is a gain factor of the driving transistor M6.

As such, the threshold voltage of the driving transistor M6 is compensated.

Figure 9:
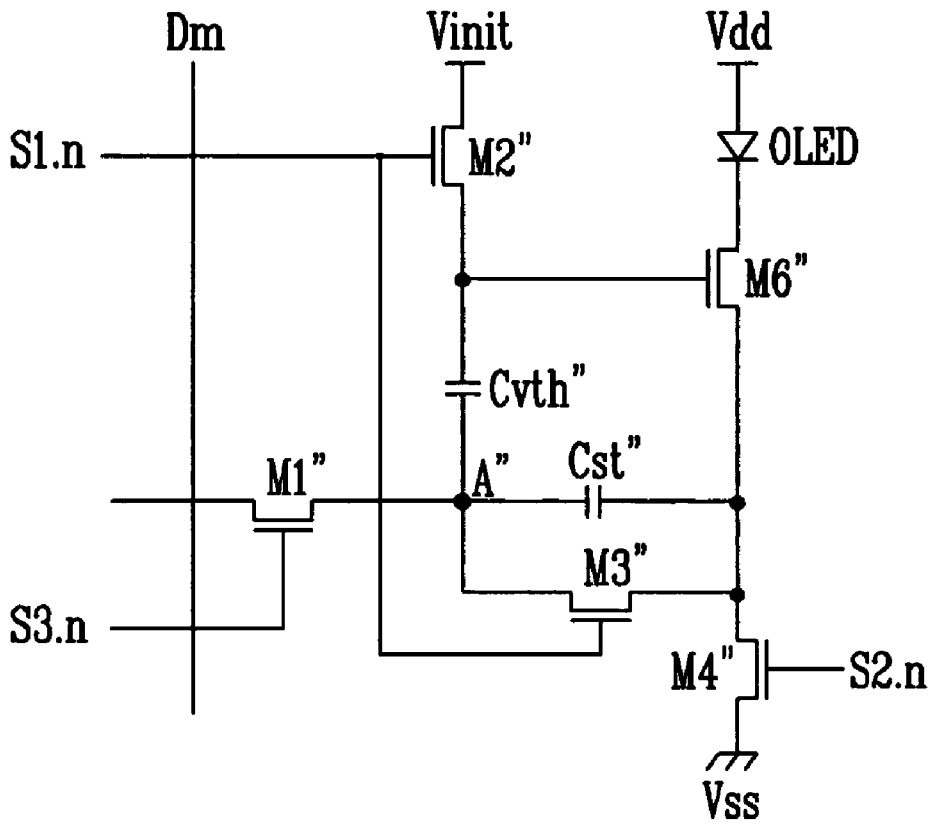
FIG. 9 is a circuit diagram in which a pixel according to an embodiment of the present invention is implemented with NMOS transistors.

FIG. 9 is a circuit diagram in which the pixel according to the present invention is implemented with NMOS transistors. Referring to FIG. 9, a pixel (e.g., the pixel 110 of FIG. 2) includes an OLED, a peripheral circuit, a first switching transistor M1", a second switching transistor M2", a third switching transistor M3", a fourth switching transistor M4", a driving transistor M6", a storage capacitor Cst", and a compensation capacitor Cvth". The first to fourth switching transistors M1", M2", M3", and M4" and the driving transistor M6" are NMOS type transistors each having a gate electrode, a source electrode, and a drain electrode, and each of the storage capacitor Cst" and the compensation capacitor Cvth" has a first electrode and a second electrode.

Here, the OLED is connected to the driving transistor M6", and the fourth switching transistor M4" is located between the driving transistor M6" and a cathode electrode of the OLED, which is an upside down type from the pixel shown in FIG. 3.

Figure 10:
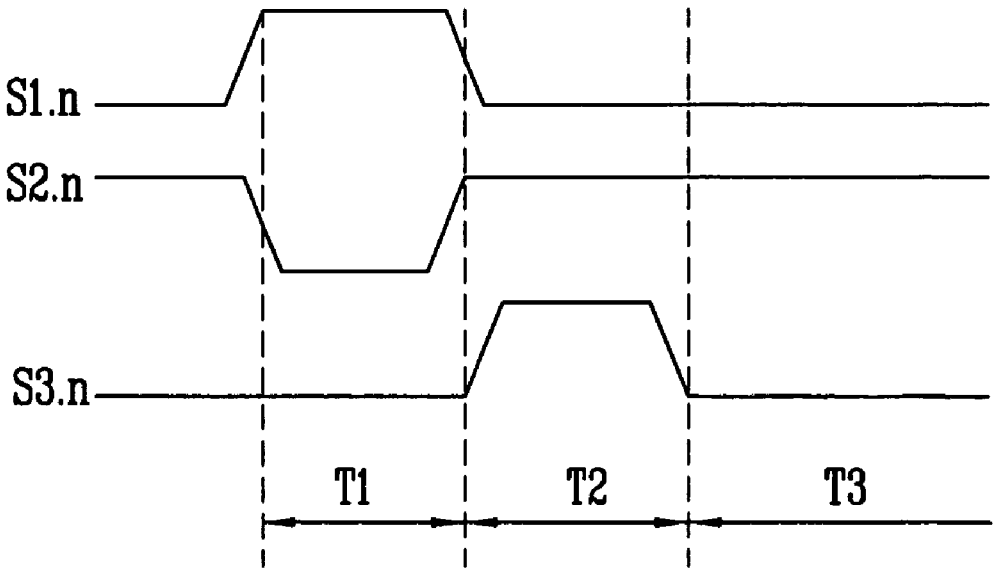
FIG. 10 is a timing diagram showing operation of the pixel shown in FIG. 9.

FIG. 10 is a timing diagram showing operation of the pixel shown in FIG. 9. Referring to FIG. 10, in the first period T1, the first scan signal S1.*n* is converted from LOW to HIGH, the second scan signal S2.*n* is converted from HIGH to LOW, and the third scan signal S3.*n* remains LOW. In the second period T2, the first scan signal S1.*n* is converted from HIGH to LOW, the second scan signal S2.*n* is converted from LOW to HIGH, and the third scan signal S3.*n* is converted from LOW to HIGH. In the third period T3, the first scan signal S1.*n* remains LOW, the second scan signal S2.*n* remains HIGH, and the third scan signal S3.*n* is converted into LOW and remains LOW. Here, the first scan signal, the second signal, and the third scan signal S1.*n*, S2.*n*, and S3.*n* are periodic signals.

According to an organic light emitting diode display according to the present invention, a current flowing through a driving transistor flows irrespective of the threshold voltage of the driving transistor so that a difference between the threshold voltages at the driving transistor is compensated, and a non-uniform brightness is prevented. In addition, it is possible to improve a contrast of the display image by preventing a leakage current from flowing into the light emitting diode.

Although certain embodiments of the present invention have been shown and described, it would be appreciated by those skilled in the art that changes might be made in these embodiments without departing from the principles and spirit of the invention, the scope of which is defined in the claims and their equivalents.

What is claimed is:

1. A pixel comprising:

a first capacitor connected between a first node and a second node;

a second capacitor connected between the first node and a third node;

a first switching device connected between a data line and the first node, and for selectively delivering a data signal to the first node;

a second switching device connected to the second node, and for selectively delivering a first power of a first power source to the second node;

a third switching device connected to the first node and the third node, and for selectively delivering a voltage at the third node to the first node;

a fourth switching device connected to the third node, and for selectively delivering a second power of a second power source to the third node, wherein the fourth switching device is configured to be turned on at substantially a same time as when the second switching device is configured to be turned off, and to be turned off at substantially a same time as when the second switching device is configured to be turned on;

a driving device connected to the second node, and for causing a driving current to flow in response to a voltage at the second node; and a light emitting device connected to the driving device, and for emitting a light in response to the driving current flowing into the light emitting device.

2. The pixel according to claim 1, wherein the first power comprises a voltage adapted to cause the driving device to remain in an off state.

3. The pixel according to claim 1, further comprising a fifth switching device for blocking a current from flowing into the light emitting device in response to a scan signal.

4. The pixel according to claim 3, wherein the fifth switching device comprises a transistor connected to the light emitting device in parallel.

5. The pixel according to claim 1, further comprising a fifth switching device, wherein the fourth switching device is configured to selectively deliver the second power of the second power source to the third node in response to a scan signal, and wherein the fifth switching device is for blocking a current from flowing into the light emitting device in response to the scan signal.

6. A pixel comprising:

a light emitting device;

a driving transistor for causing a driving current to flow through the light emitting device;

a first switching unit for selectively delivering a data signal;

a second switching unit for selectively delivering a first power of a first power source to the driving transistor and a storage unit; and the storage unit for applying a voltage to a gate electrode of the driving transistor, wherein, when the first power is not delivered to the storage unit, the storage unit is configured to apply a second power of a second power source to the gate electrode of the driving transistor to store a first voltage, wherein the storage unit is then configured to store a second voltage corresponding to the data signal and to apply the first voltage and the second voltage to the gate electrode of the driving transistor, and wherein the first voltage comprises a voltage difference between a source electrode of the driving transistor and the gate electrode of the driving transistor, wherein when the first power is delivered to the storage unit, the storage unit is not configured to apply the second power of the second power source to the gate electrode of the driving transistor.

7. The pixel according to claim 6, wherein the first switching unit comprises a switching transistor operating in response to a scan signal.

8. The pixel according to claim 6, wherein the storage unit comprises:

a first switching transistor for selectively delivering the second power to the gate electrode of the driving transistor according to a scan signal;

a second switching transistor for selectively delivering a voltage of a source electrode of the driving transistor when the second power is delivered to the gate electrode of the driving transistor according to the scan signal;

a first capacitor for storing the first voltage; and a second capacitor for storing the second voltage.

9. The pixel according to claim 6, wherein the second switching unit comprises a switching transistor for selectively delivering the first power in response to a scan signal.

10. The pixel according to claim 6, further comprising a switching transistor for blocking a current from flowing into the light emitting device in response to a same scan signal provided to control the second switching unit.

11. The pixel according to claim 6, wherein the first switching unit comprises a first switching transistor operating in response to a third scan signal, wherein the storage unit comprises:

a second switching transistor for selectively delivering the second power to the gate electrode of the driving transistor according to a first scan signal;

a third switching transistor for selectively delivering a voltage of a source electrode of the driving transistor when the second power is, delivered to the gate electrode of the driving transistor according to the first scan signal;

a first capacitor for storing the first voltage; and a second capacitor for storing the second voltage, and wherein the second switching unit comprises a fourth switching transistor for selectively delivering a first power in response to a second scan signal.

12. The pixel according to claim 11, further comprising a fifth switching transistor for blocking a current from flowing into the light emitting device in response to the second scan signal.

13. The pixel according to claim 12, wherein the fourth switching transistor and the fifth switching transistor remain in different on-and-off states.

14. The pixel according to claim 13, wherein the second power is a voltage for causing the driving transistor to remain in an off state.

15. A pixel comprising:

a light emitting device;

a driving transistor for causing a current to flow through the light emitting device;

a second switching transistor for selectively delivering a first power of a first power source to a gate electrode of the driving transistor in response to a first scan signal;

a third switching transistor for selectively delivering a voltage at a source electrode of the driving transistor in response to the first scan signal when the first power is applied to the gate electrode of the driving transistor;

a fourth switching transistor for selectively delivering a second power of a second power source to the driving transistor in response to a second scan signal, wherein the fourth switching transistor is configured to be turned on at substantially a same time as when the second switching transistor is configured to be turned off, and to be turned off at substantially a same time as when the second switching transistor is configured to be turned on;

a first switching transistor for selectively delivering a data signal in response to a third scan signal;

a first capacitor for storing a voltage having a voltage difference between the delivered data signal and the second power; and a second capacitor for storing a voltage having a threshold voltage of the driving transistor, wherein the driving transistor causes the current to flow through the light emitting device in response to the voltage stored into the first capacitor and the voltage stored into the second capacitor.

16. The pixel according to claim 15, wherein the first power causes the driving transistor to remain in an off state.

17. The pixel according to claim 15, further comprising a fifth switching transistor for blocking a current from flowing into the light emitting device.

18. The pixel according to claim 17, wherein the fourth switching transistor and the fifth switching transistor remain in different on-and-off states.

19. An organic light emitting diode display comprising:

a plurality of scan lines comprising a first scan line, a second scan line, and a third scan line;

a data line for delivering data signals; and a plurality of pixels connected to the scan lines and the data line, wherein at least one of the pixels comprises:

a light emitting device;

a driving transistor for causing a current to flow through the light emitting device;

a second switching transistor for selectively delivering a first power of a first power source to a gate electrode of the driving transistor in response to a first scan signal;

a third switching transistor for selectively delivering a voltage at a source electrode of the driving transistor in response to the first scan signal when the first power is applied to the gate electrode of the driving transistor;

a fourth switching transistor for selectively delivering a second power of a second power source to the driving transistor in response to a second scan signal, wherein the fourth switching transistor is configured to be turned on at substantially a same time as when the second switching transistor is configured to be turned off, and to be turned off at substantially a same time as when the second switching transistor is configured to be turned on;

a first switching transistor for selectively delivering at least one of the data signals in response to a third scan signal;

a first capacitor for storing a voltage having a voltage difference between the delivered data signal and the second power; and a second capacitor for storing a voltage having a threshold voltage of the driving transistor, wherein the driving transistor causes the current to flow through the light emitting device in response to the voltage stored into the first capacitor and the voltage stored into the second capacitor.

20. The organic light emitting diode display according to claim 19, further comprising a scan driver connected to the first, second, and third scan lines for delivering the first, second, and third scan signals, respectively.

21. The organic light emitting diode display according to claim 20, further comprising a data driver for delivering the data signals.

22. The organic light emitting diode display according to claim 19, wherein the first power causes the driving transistor to remain in an off state.

23. The organic light emitting diode display according to claim 22, further comprising a fifth switching transistor connected to the light emitting display in parallel, and for blocking a current from flowing into the light emitting device.

24. The pixel according to claim 17, wherein the fourth switching transistor and the fifth switching transistor are of different transistor types.

* * * * *